US005317878A

United States Patent [19]

Bradshaw et al.

[11] Patent Number: 5,317,878

[45] Date of Patent: Jun. 7, 1994

[54] CRYOGENIC COOLING APPARATUS

[75] Inventors: Thomas W. Bradshaw, Wantage; Anna H. Orlowska, Oxford, both of England

[73] Assignee: British Technology Group Ltd., London, United Kingdom

[21] Appl. No.: 923,901

[22] PCT Filed: Feb. 28, 1991

[86] PCT No.: PCT/GB91/00311

§ 371 Date: Aug. 20, 1992

§ 102(e) Date: Aug. 20, 1992

[87] PCT Pub. No.: WO91/14141

PCT Pub. Date: Sep. 19, 1991

[30] Foreign Application Priority Data

Feb. 28, 1990 [GB] United Kingdom ..... 9004427

[51] Int. Cl.[5] ..... F25B 19/02

[52] U.S. Cl. ..... 62/6; 62/51.1; 62/51.2

[58] Field of Search ..... 62/6, 51.1, 51.2

[56] References Cited

U.S. PATENT DOCUMENTS

| | | | |
|---|---|---|---|
| 1,829,096 | 10/1931 | Kramer . | |
| 3,125,863 | 3/1964 | Hood, Jr. . | |
| 3,375,675 | 4/1968 | Trepp et al. . | |
| 3,415,077 | 12/1968 | Collins . | |
| 3,656,313 | 4/1972 | Low et al. | 62/85 |
| 3,802,211 | 4/1974 | Bamberg et al. . | |
| 4,077,231 | 3/1978 | Fletcher et al. . | |
| 4,223,540 | 9/1980 | Longsworth . | |
| 4,567,943 | 2/1986 | Longsworth et al. | 62/51.2 X |
| 4,606,201 | 8/1986 | Longsworth | 62/51.2 |
| 4,766,741 | 8/1988 | Bartlett et al. | 62/51.2 |
| 4,840,043 | 6/1989 | Sakitani et al. | 62/51.2 |
| 5,060,481 | 10/1991 | Bartlett et al. | 62/51.2 |

FOREIGN PATENT DOCUMENTS

| | | |
|---|---|---|
| 557093 | 2/1946 | United Kingdom . |
| 1290377 | 9/1972 | United Kingdom . |
| 1417110 | 12/1975 | United Kingdom . |
| 2149901 | 6/1985 | United Kingdom . |

OTHER PUBLICATIONS

T. W. Bradshaw et al.: "A 4-K mechanical refrigerator for space applications" pp. 393-397; FIGS. 4, 5 cited in the application unknown.

*Primary Examiner*—Henry A. Bennett
*Assistant Examiner*—Christopher B. Kilner
*Attorney, Agent, or Firm*—Cushman, Darby & Cushman

[57] ABSTRACT

The invention provides a controlled connection, or heat switch, between a source of cryogenic cooling and an item which is to be cooled, using control valve means which is not itself subjected to the cryogenic temperatures involved. In one aspect, the invention provides cooling means, comprising a source of flow of a fluid, a supply line for supplying fluid from said source to a first heat exchanger, where it is cooled by a source of cryogenic cooling, and thereafter to a second heat exchanger where it is in heat-exchanging relationship with an item to be cooled by the cryogenic cooling source, and a return line for return flow of the fluid from the second heat exchanger to the fluid flow source, the return line and the supply line between the fluid flow source and the first heat exchanger being in heat exchange relationship with one another in a third heat exchanger, wherein between the fluid flow source and the third heat exchanger there is included in the supply line or the return line a control valve whereby the flow of fluid through the supply line and from the first to the second heat exchanger can be controlled. One embodiment is constituted by a multi-stage cryogenic cooling apparatus having a closed-loop Joule-Thomson expansion the compressor via a low-pressure return line), and a Joule-Thomson stage heat exchanger in which the high-pressure line and the low-pressure return line are in heat-exchanging relationship, and the pre-cooler stage being arranged to pre-cool gas in the high-pressure line before it enters the Joule-Thomson stage heat exchanger, wherein the high-pressure gas line of the Joule-Thomson stage is provided, upstream of its interaction with the pre-cooler stage, with a branch leading through a bypass valve.

11 Claims, 3 Drawing Sheets

CRYOGENIC COOLING APPARATUS

Figure 1:
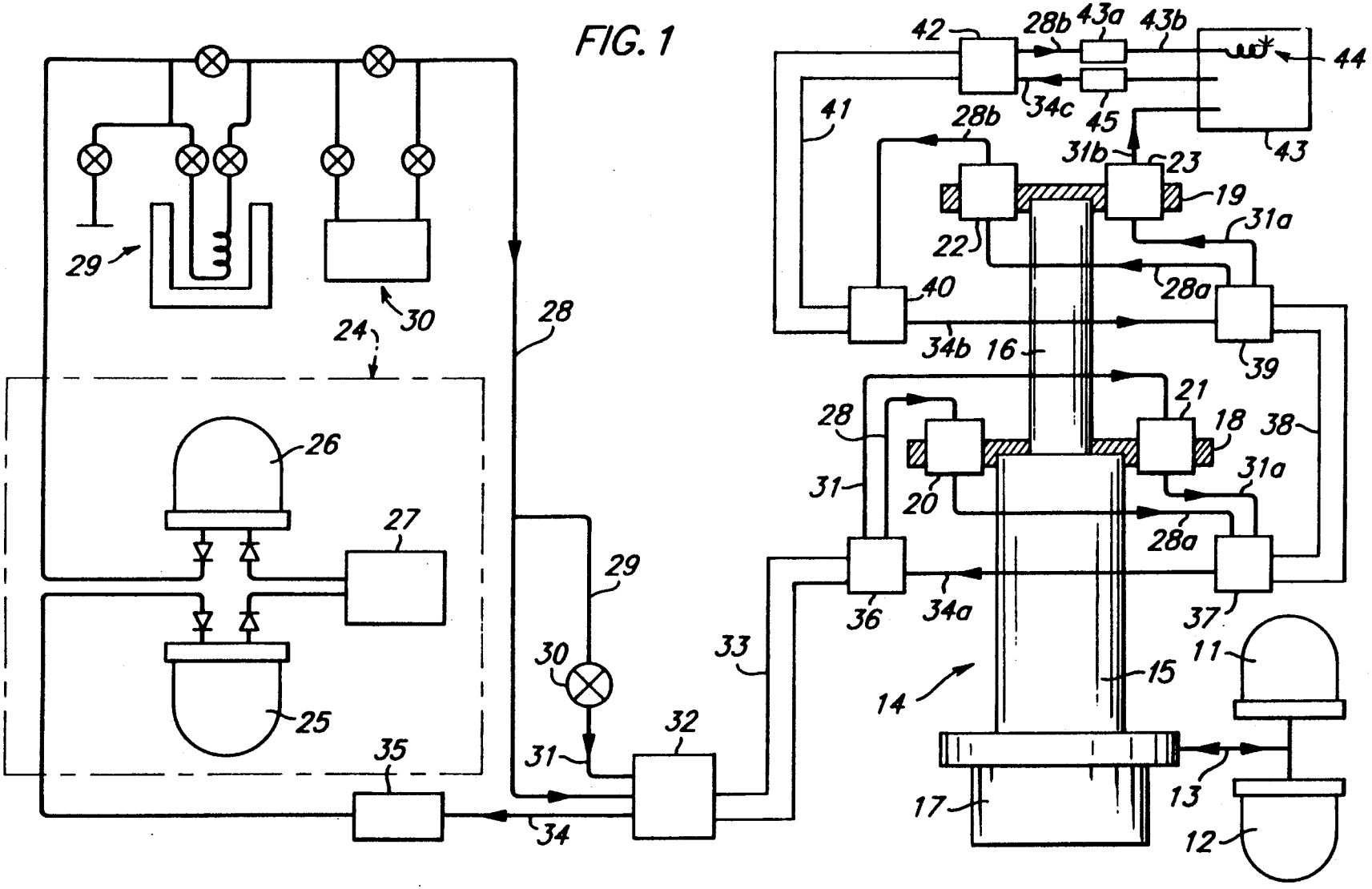

This invent on relates to cryogenic cooling apparatus.

There are numerous scientific, technological and industrial situations in which a need for cryogenic cooling arises. For example, the performance of many detector devices used for the detection or measurement of very small incident signals is enhanced by reducing the detector-device temperature so as to achieve an improved signal-to-noise ratio. Such cooling has been accomplished in the past by the use of stored, solid or liquid cryogens, but such systems have a limited life and a large mass which makes them unsuitable for use in, for example, cooling the detector devices of measuring apparatus carried aboard space probes or earth satellites. Increase in the useful lifetime without undue increase in the overall mass may be achieved by employing a closed cycle cooling system in which the cryogenic working substance, instead of being used "once through" and then exhausted, is recycled indefinitely; and solar-powered electrically-driven Stirling-cycle refrigerators using helium as their cryogenic working fluid have indeed been developed for such purposes. A single-stage Stirling-cycle refrigerator is capable of achieving temperatures down to about 80° K., but for many applications lower temperatures are desirable or necessary. A two-stage Stirling-cycle refrigerator capable of achieving temperatures below 20° K. and of producing 200 mW of refrigeration at 30° K., with an operating frequency of about 35 Hz and an electrical driving power input of some 90 watts, has recently been described by the inventors of the present invention (Bradshaw, T.W. and Orlowska, A.H.: Proceedings of the 3rd European Symposium on Space Thermal Control and Life Support Systems: ESA SP-288 (1988)); but a Stirling-cycle machine and, indeed, any regenerative-cycle machine, must become increasingly inefficient at very low temperatures due, mainly, to decreasing regenerator effectiveness.

In order to reach very low temperatures (around 4° K.) it is therefore necessary in practice to introduce a non-regenerative cooling stage, and it is known in this context to make use of the Joule-Thomson (J-T) expansion effect, namely that a gas, under high pressure and at a temperature below its inversion temperature, becomes cooled when it is allowed to expand through a flow constrictor to a lower pressure. However, the inversion temperatures of many gases, including helium, are well below ordinary room temperature, and therefore they must first be precooled before they can be further cooled by use of the J-T effect. The required precooling may be effected by means of any suitable refrigerating apparatus, which may, for example, be a Stirling-cycle refrigerator such as one of those referred to above.

The present invention relates, therefore, in one of its aspects, to a multi-stage cryogenic cooling apparatus having a closed-loop J-T expansion stage and at least one pre-cooler stage, the J-T stage comprising a gas compressor, a J-T expansion chamber (having an outlet connected to the compressor via a low-pressure return line and an inlet arranged to receive high pressure gas via a high-pressure line from the compressor and constituted as a flow-restricting expansion valve therefor), and a J-T stage heat exchanger in which the high-pressure supply line and the low-pressure return line are in heat-exchanging relationship, and the precooler stage being arranged to pre-cool gas in the high-pressure supply line before it enters the J-T stage heat exchanger. Such a cryogenic cooling apparatus is referred to hereinafter as apparatus of the defined kind.

In such apparatus of this defined kind, high pressure gas from the compressor is precooled by the precooler stage before passing, via the J-T stage heat exchanger, to the flow-restricting expansion valve through which it expands into the expansion chamber with the effect of cooling both itself and the expansion chamber. The resulting low-pressure gas, now at the lowest temperature in the whole system, returns from the expansion chamber to the compressor via the low-pressure return line, and in doing so it passes through the J-T stage heat exchanger where it is in heat-exchanging relationship with the high-pressure gas, which is thereby cooled, before it reaches the expansion valve, to a temperature below that already achieved by means of the precooler stage.

The above-described further cooling of the high-pressure gas, below the temperature to which it is precooled by the pre-cooler stage, leads to a progressive cooldown of the expansion block until finally it (and the expanded low pressure gas whose temperature it follows) are at or just above the boiling point of the gas at its pressure on the low-pressure side of the expansion valve; but the rate at which this progressive cooldown occurs is related to the mass flow rate of the gas through the pre-cooler stage (since this governs the rate of heat removal from the J-T expansion stage). This leads to a problem, because the gas density at a given pressure decreases and its viscosity increases, with increasing temperature, with the result that a constricted expansion valve designed to provide a given mass flow rate at the very low designed operating temperature of the expansion block will limit the flow rate at higher temperatures to only a small fraction of the designed mass flow rate and will thus seriously limit the cooling effect and the rate of cooldown in the J-T stage. It has been proposed to overcome this problem by providing a variable orifice as the expansion valve and decreasing its size, as the temperature falls, until finally it allows the designed mass flow rate of gas at the low designed operating temperature of the expansion block; but this requires moving parts which are accurately controllable at very low temperatures, a requirement which is very difficult to implement reliably—especially in, for example, a miniature helium refrigerator with a designed flow rate of only a few milligrams per second at a designed operating temperature of 4° K. A variant which has also been proposed is to provide a fixed-orifice expansion valve dimensioned appropriately for the operating low-temperature conditions and to provide, in parallel with it and also within the expansion block, a bypass valve which, when open, has a much larger orifice and allows a correspondingly increased flow of gas from the high-pressure line into the expansion block and thence into the low-pressure return line. In this case, the resulting increased flow rate of gas through the J-T stage heat exchanger (in both directions) and through the expansion block while the bypass valve is open leads to a more rapid cooldown of both components to the temperature of the precooler stage, after which the bypass valve is closed so that subsequent flow is only through the constricted expansion valve; but this variant also suffers from the disadvantage that the bypass valve is required to be operable to close it in low-temperature conditions.

It is an object of the present invention to provide, in apparatus of the defined kind, means whereby the rate of cooldown of the J-T expansion stage may be increased without the use of components having moving parts which are required to operate under low-temperature conditions.

To that end, with the high-pressure gas supply line of the J-T stage of apparatus of the defined kind being provided, upstream of its interaction with the precooler stage, with a branch leading through a bypass valve (when open) to a bypass line which opens into the expansion chamber and offers a less constricted gas route -than the flow-restricting expansion valve, the invention provides that, the precooler stage being arranged to cool gas flowing in the bypass line downstream of the bypass valve, the bypass line then leads direct from the pre-cooler stage to the expansion chamber without passing through the J-T stage heat exchanger.

According to another aspect of the invention, the invention provides cooling means comprising a source of flow of a fluid, a supply line for supplying fluid from said source to a first heat exchanger, where it is cooled by a source of cryogenic cooling, and thereafter to a second heat exchanger where it is in heat-exchanging relationship with an item to be cooled by the cryogenic cooling source, and a return line for return flow of the fluid from the second heat exchanger to the fluid flow source, the return line and the supply line between the fluid flow source and the first heat exchanger being in heat exchange relationship with one another in a third heat exchanger, and there being provided in the supply line between the fluid flow source and the third heat exchanger a control valve whereby the flow of fluid through the supply line and from the first to the second heat exchanger can be controlled, wherein there is provided, extending in parallel with the said supply line through the third heat exchanger (in heat exchanging relationship with the return line) and through the first heat exchanger (to be cooled by the cryogenic cooling source) a further supply line connected to supply fluid from the fluid source to the second heat exchanger, with the second heat exchanger constituting a Joule-Thomson expansion chamber and the further supply line opening thereinto through an inlet constituted as a flow-restricting expansion valve therefor. The return line then constitutes a fluid outlet from the Joule-Thomson expansion chamber, and the fluid supply line having the said control valve connected in it opens into the expansion chamber through a less restricting inlet than that provided for the said further supply line, whereby fluid flow into the expansion block is preferentially through the supply line having the control valve connected in it or through the further supply line, respectively, according as the control valve is open or closed.

Figure 2:
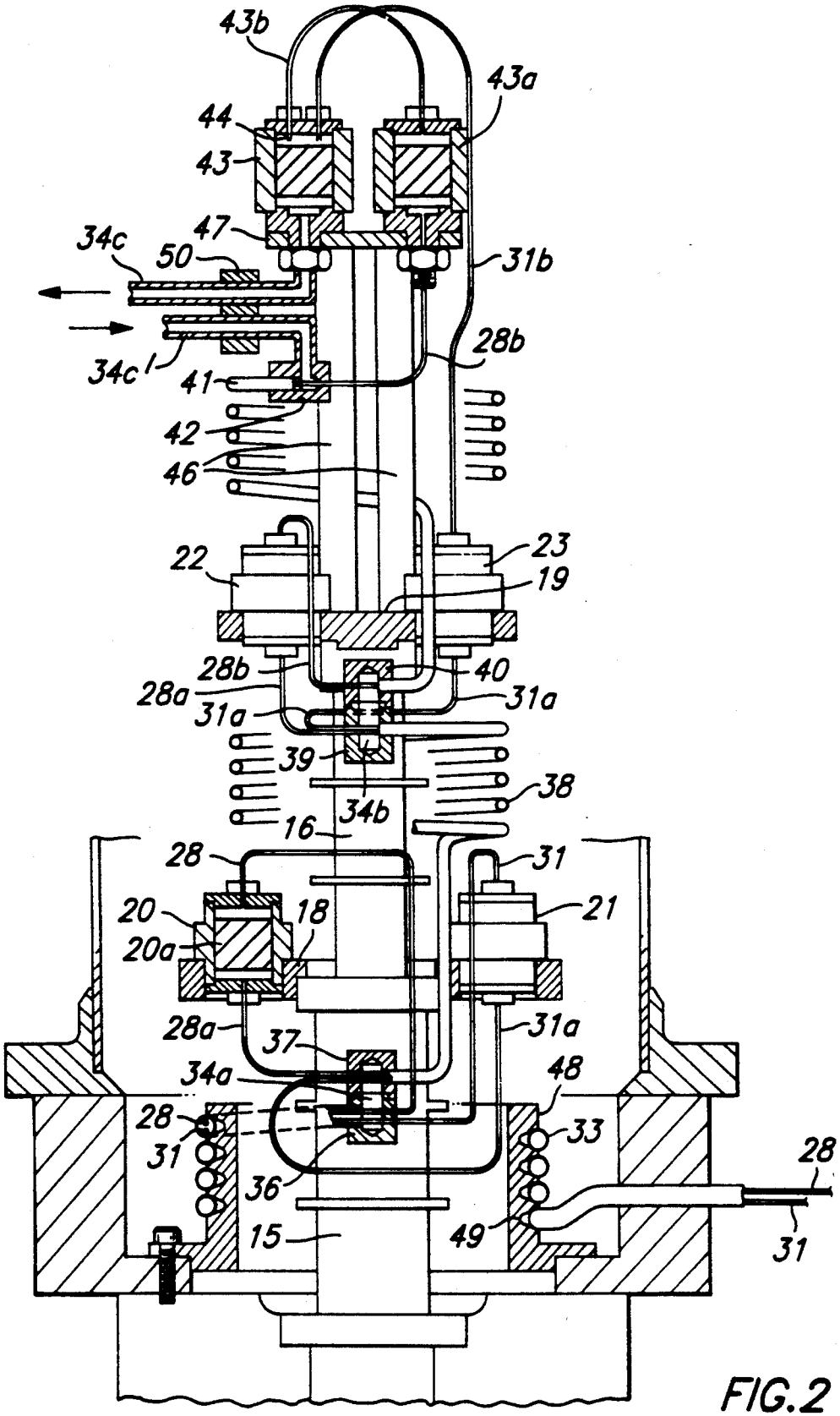
Figure 3:
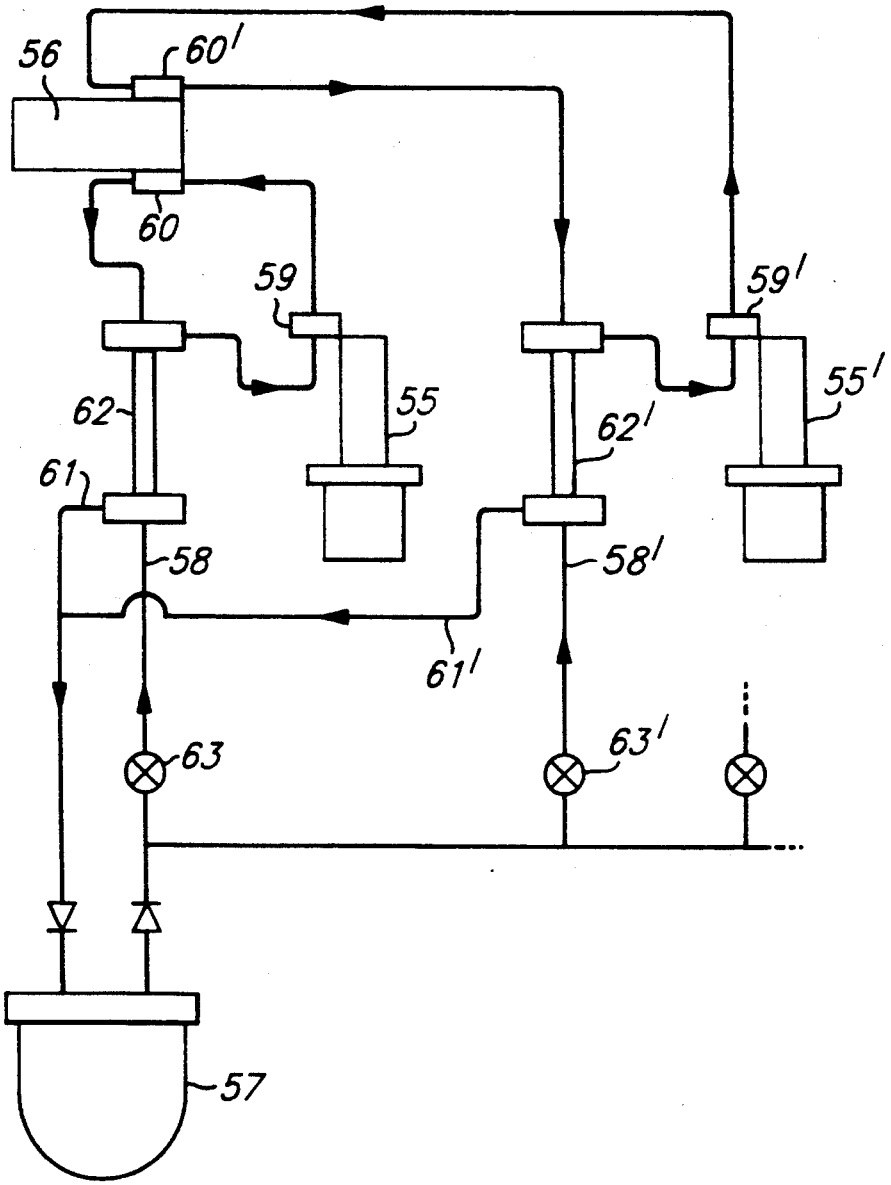

These and other aspects and advantageous and preferred features of the invention will be disclosed below in the following description with reference to the accompanying drawings, in which:

FIG. 1 is a schematic diagram of apparatus of the defined kind which incorporates the invention, FIG. 2 is a view, partly in elevation and partly in axial longitudinal section, of a preferred practical embodiment of that part of the apparatus represented in FIG. 1 which is shown in the right-hand half of that FIG., and FIG. 3 is a schematic diagram of apparatus in which a heat switch provides control of cooling, by a source of cryogenic cooling, of an item which is to be cooled thereby.

The cryogenic cooling apparatus represented in FIG. 1 comprises a closed-loop J-T expansion stage, using helium as its working fluid, and a two-stage Stirling-cycle refrigerator which provides two successive precooler stages for the helium of the J-T stage. The Stirling-cycle refrigerator, which is of the known kind described in the above-cited paper by the inventors of the present invention, comprises a pair of electrically driven compressors 11 and 12 which are mounted rigidly with respect to one another, in alignment but in mechanical opposition so that cyclical momentum changes in the one are balanced and cancelled out by the equal and opposite changes in the other, and which act in phase with one another, though a common output line 13, on a displacer unit 14 in which accordingly they effect alternate compression and decompression, suitably at a cycle frequency of about 35 Hz, of the Stirling-cycle working fluid which conveniently may also be helium. The displacer unit 14 comprises a stepped cylinder having larger-diameter and small-diameter sections 15 and 16 respectively within which a stepped displacer piston (not shown) is reciprocated, by electrical drive means (not shown, but housed within a housing 17), at the same frequency as that of the compressors 11 and 12 but with a phase displacement of approximately one quarter of a cycle relative thereto. Preferably the displacer unit drive means is a moving coil motor comprising, in known manner, a coil mounted on the stepped displacer piston for axial movement therewith and disposed in a coaxial annular gap of a permanent magnet system so as to be excited into axial oscillation when supplied with an alternating current from an a.c. current source (not shown); and the compressors 11 and 12, preferably, similarly comprise moving coil motors supplied, with the required phase displacement relative to the displacer unit, with driving current from the same source.

Larger-diameter and smaller-diameter sections of the stepped piston of the displacer unit 14 are both hollow to accommodate respective axially-extending regenerator units communicating at their ends with respective working chambers defined between the stepped cylinder 15, 16 and the stepped piston disposed within it; two of these chambers are located, within the stepped cylinder, at the upper ends of its sections 15 and 16 respectively, and operation of the Stirling-cycle refrigerator results in cooling of the adjacent parts of the cylinder wall, and of respective thermally-conductive collars 18 and 19 mounted thereon in good thermal contact therewith, to temperatures which may be as low as about 100° K. and 20° K. respectively. The collar 18 has two apertures in which are mounted two precooler units 20 and 21 which are in good thermal contact with the collar 18; and the collar 19 is similarly provided with two further gas precooler units 22 and 23.

The pre-cooler units 20 and 21 , and 22 and 23, provide pre-cooler stages for the Joule-Thomson section of the apparatus. This comprises a compressor unit composed of two compressors 25 and 26 arranged in series with a buffer volume or receiver 27 between them. The compressors 25 and 26 are preferably similar to the compressors 11 and 12 and, like them, mounted in alignment but in mechanical opposition so that oscillating momentum forces tend to cancel one another; but the compressors 25 and 26 differ in that they, unlike the compressors 11 and 12, are fitted with one-way inlet and outlet valves so that low-pressure helium drawn into the compressor 25 is fed under pressure into the receiver 27 and is then further compressed by the compressor 26 and fed to a high pressure gas line 28 fitted, preferably, with a liquid nitrogen trap 29 and a getter 30 for other impurities in the helium. The trap 29 and getter 30 are shown in FIG. 1 as being introducible into and removable from the line 28 at will, by appropriate operation of associated valves; but in practice the trap 29, which is used as the means by which the Joule-Thomson section of the apparatus is filled with its working fluid, would usually thereafter be permanently removed whereas the getter 30 would usuallybe left permanently in the circuit.

The high-pressure line 28 has a branch 29 leading to a normally closed valve 30 which, when open, allows helium into a bypass line 31; and the high-pressure line 28 and the bypass line 31 pass together via a manifold 32 into a first countercurrent heat exchanger 33 in which they are in heat-exchanging relationship with low-pressure helium which has undergone the Joule-Thomson expansion and which emerges from the manifold 32 to connect via a return line 34 with a low-pressure helium receiver 35 which supplies the inlet side of the compressor 25. At its end remote from the manifold 32, the heat exchanger 33 has a manifold 36 from which the high-pressure line 28 and bypass line 31 emerge to open into the pre-cooler units 20 and 21 respectively. Extensions 28*a* and 31*a* of the lines 28 and 31 respectively then lead from the precooler units 20 and 21 respectively through a manifold 37 into a second countercurrent heat exchanger 38, to emerge therefrom via a manifold 39 and open into the precooler units 22 and 23 respectively. A further extension 28*b* of the high pressure line 28 leads from the pre-cooler unit 22 via a manifold 40 into a third countercurrent heat exchanger 41 from which it emerges via a manifold 42 to pass finally via a filter 43*a* and an inlet line 43*b* into the expansion chamber of a Joule-Thomson expansion chamber 43 in which the inlet line 43*b* terminates in a restricted-orifice expansion valve 44. The precooler unit 23, on the other hand, is connected by a further extension 31*b* of the bypass line, which bypasses the third heat exchanger 41, directly into the expansion chamber of the expansion chamber 43, into which it opens without any constriction comparable to the expansion valve 44.

The low-pressure return line 34 opens, through the manifold 32, to the space surrounding the high-pressure and bypass lines 28 and 31 within the outer tube of the heat exchanger 33, and that space communicates through the manifold 36 and a return line section 34*a* with the manifold 37 and, therethrough, with the similar space within the outer tube of the heat-exchanger 38. That space, similarly, communicates through the manifold 39 and a return line section 34*b* with the manifold 40 and, therethrough, with the space surrounding the high-pressure line section 28*b* within the outer tube of the heat exchanger 41; and the space within the heat exchanger 41 communicates, through the manifold 42, with the expansion chamber 43 by means of a low-pressure return line section 34*c* which includes a load 45 whose cryogenic cooling it is the purpose of the above-described apparatus to provide. Thus low-pressure helium, leaving the expansion chamber 43 through the return line section 34*c*, flows in turn through the load to be cryogenically cooled and then through the heat exchangers 41, 38 and 33 and, via the line 34, back into the receiver 35.

It will be understood that although, for purposes of illustration, the load 45 is shown as being included in the section 34*c* of the low-pressure return line and being cooled by actual passage through it of the cold low-pressure helium, the load to be cooled may alternatively (in the manner illustrated in FIG. 3 as described below) be cooled, without being part of the helium circuit, by being in good thermal contact, i.e. in heat-exchanging relationship, with the expansion chamber 43 together with which, accordingly, it forms a heat exchanger.

With the valve 30 open, compressed helium flowing through the bypass line 31 is cooled in the heat exchangers 33 and 38 by countercurrent heat exchange with the expanded helium returning to the receiver 35 and al so by its passage through the precooler units 21 and 23 which are chilled to about 100° K. and 20° K. respectively. The relatively large rate of flow of helium through this route, via the valve 30, enables the temperature of the expansion chamber 43 to be reduced relatively quickly to a level at which the J-T effect is efficient and flow rate through the valve 44 approaches its designed value. Closure of the valve 30 then prevents further flow through the bypass route, and subsequent flow of high-pressure helium from the line 28 is through all three heat exchangers 33, 38 and 41 , as well as through the two precooler units 20 and 22, whereafter the expansion of the helium through the expansion valve or nozzle 44 provides the final cooling down to about 4° K. In this final, operating, condition of the apparatus there will be a substantial temperature difference between the expansion chamber 43 and the precooler unit 23, between which the final section 31*b* of the now-inoperative bypass line extends; but it should be noted that undesired thermal leakage along the section 31*b* can be made satisfactorily small because section 31*b* will usually be a fine tube of small cross-section and can be of substantial length.

A practical embodiment of an assembly constituting the major part of the right-hand side of FIG. 1 is shown in FIG. 2, in which the same reference numerals are used as for the corresponding elements in FIG. 1. As shown in FIG. 2, the larger- and smaller-diameter sections 15 and 16 of the stepped cylinder of the displacer unit 14 of the Stirling-cycle refrigerator constitute a central spine around which the assembly is built. The collar 18, mounted on the shoulder between the sections 15 and 16, has two apertures in which the pre-cooler units 20 and 21 respectively are received as interference fits and thereby located; and the precooler units 22 and 23 are similarly located as interference fits in apertures in the collar 19 which is secured on the free upper end of the section 16. Also mounted on the upper end of the section 16 are two pillars 46 of a good thermal insulating material, on the upper ends of which is mounted a thermally conductive support 47 on which the filter 43*a* and the Joule-Thomson expansion chamber 43 are secured in thermal contact with the support and thus with one another.

The three heat exchangers 33, 38 and 41 in this embodiment are all, as shown in FIG. 2, of the coiled tube-in-tube type.

An annular mandrel 48 is secured in place round the displacer unit cylinder section 15, coaxial therewith, and the heat exchanger 33 is coiled round the mandrel, seated in a spiral groove 49 thereof. At its upper end, the outer tube of the heat exchanger 33 is brazed into a lateral opening of the manifold 36 and thereby opens into an axial bore of the manifold. The high-pressure line 28 and bypass line 31 emerging from the end of the heat exchanger outer tube extend across the axial bore of the manifold 36 and out of the manifold through two small lateral openings, in which they are sealed by brazing, opposite the larger bore in which the end of the outer tube of the heat exchanger 33 is brazed (and thereby sealed). The emerging high-pressure line 28 and bypass line 31 are led to apertures in the upper ends of the precooler units 20 and 21 respectively, in which they are brazed so as to seal those apertures whilst being communication with the interiors of the units.

The manifold 37 for the heat exchanger 38 is brazed in place on the manifold 36 and has an axial internal bore communicating with that of the manifold 36 and constituting therewith the duct 34*a* identified in FIG. 1. The manifold 37 has a lateral opening in which the lower end of the outer tube of the heat exchanger 38 is brazed, and thereby sealed, in communication with the duct 34*a*. The inner tubes 28*a* and 31*a* of the heat exchanger 38, where they emerge from the lower end of its outer tube, extend across the duct 34*a* and emerge from the manifold 37 through two lateral openings (in which they are sealed by brazing) to be led to apertures in the lower ends of the precooler units 20 and 21 respectively into which they are sealed by brazing so as to be in communication through the units 20 and 21 with the high-pressure line 28 and the bypass line 31 respectively.

The manifolds 39 and 40 are formed and connected in similar manner as the manifolds 36 and 37, so that they provide an internal duct 34*b* through which the outer tubes of the heat exchangers 38 and 41 are in communication with one another. The upper ends of the inner tubes 28*a* and 31*a* of the heat exchanger 38 emerge from the manifold 39 and are sealed into the lower ends of the precooler units 22 and 23 respectively, and the single inner tube 28*b* of the heat exchanger 41 emerges at its lower end from the manifold 40 and is sealed into the upper end of the pre-cooler unit 22. The upper end of the tube 28*b* emerges from the manifold 42 and is sealed into the lower end of the filter 43*a*, the upper end of which is connected to the Joule-Thomson expansion chamber 43 by the inlet line 43*b* which terminates, within the chamber 43, in the restricted orifice or valve 44 through which the Joule-Thomson expansion takes place. The bypass line extension 31*b*, which bypasses the heat exchanger 41, extends from the upper end of the precooler unit 23, is led past the filter 43*a* (in good thermal contact with-it so as to cool it) and opens into the upper end of the Joule-Thomson chamber 43 adjacent the valve 44 but without itself having any comparable constriction.

The outlet duct 34*c* from the base of the chamber 43 leads to the load (45 in FIG. 1, but not shown in FIG. 2) which is to be cooled cryogenically, and the return duct 34*c*′ from the load communicates through the manifold 42 with the interior of the outer tube of the heat exchanger 41. The ducts 34*c* and 34*c*′ are preferably not in direct- thermal contact, but are mechanically located relative to one another by a spacer member 50, which supports the weight of the heat exchanger 41. As explained above with reference to FIG. 1, however, the load which is to be cooled may be cooled by being in thermal contact with the expansion chamber 43 rather than by having the cold gas from the expansion chamber flowing through it, and in that case the ducts 34*c* and 34*c*′ will be integral with one another, leading direct from the expansion chamber 43 to the manifold 42.

It will be seen that the assembly of the heat exchangers 33, 38 and 41 together with the manifolds 36, 37, 39, 40 and 42 forms an integrated structure which is supported at its upper end by the spacer member 50 and at its lower end by the mandrel 48 but which is otherwise out of physical and thermal contact with the remainder of the apparatus apart from the connections of the ends of the heat-exchanger inner tubes to the precooler units 20, 21, 22 and 23. This arrangement is effective to minimize unwanted heat leakage between the heat exchangers and other parts of the apparatus. The desired heat transfers within the pre-cooler units are maximized by providing them with a gas-permeable filling, such as the illustrated filling 20*a* of the unit 20, which has high thermal conductivity and is in good thermal contact with the walls of the precooler unit and therethrough with the cold collar 18 or 19 respectively. The filling 20*a* may be in the form, for example, of a stack of circular discs cut from a sheet of metal gauze, or may be a strip of such gauze wound into a roll. The filter 43*a* may be provided with a similar filling to act as a filter element, and a similar filling may also be provided in the expansion chamber 43 to maximize thermal contact with the cold expanded gas issuing from the expansion nozzle 44.

Another instance of the control of coolant flow at a low-temperature region by means of a control valve remote from the low temperature, is illustrated in FIG. 3 and will now be described with reference thereto.

As shown in FIG. 3, a source 55 of cryogenic cooling is represented by a Stirling-cycle refrigerator, and an item 56 is to be cooled by it, under control of a valve which is not, itself, to be subjected to the cryogenic conditions. There is therefore provided a circulating pump 57 with one-way inlet and outlet valves, for providing a flow of fluid through a supply line 58 to a first heat exchanger 59 in which it is cooled by the cryogenic cooling source 55 and thereafter to a second heat exchanger 60 in which it is in heat exchanging relationship with the item 56 which is to be cooled. A return line 61 for flow of the fluid from the heat exchanger 60 back to the pump 57 is also provided, as is a third heat exchanger 62 in which the return line 61 is in heat-exchanging relationship with the supply line 58 between the pump 57 and the first heat exchanger 59. Between the pump 57 and the third heat exchanger 62 there is provided (in the supply line 58 as illustrated, though it might equally well be in the return line 61) a valve 63 by which fluid flow through the supply line to the heat exchanger 59, and from it to the heat exchanger 60, can be con-trolled. The circuit just described may be one of a plurality of such circuits, all supplied by the pump 57 : thus a second such circuit, controlled by a valve 63′ and including a heat exchanger 62′, may be provided for cooling the item 56 by means of a heat exchanger 60′ receiving cooled fluid from a heat exchanger 59′ which is cooled by a second source 55′ of cryogenic cooling.

With the pump 57 operating, opening the valve 63 causes fluid to flow through the heat exchanger 59 and be cooled by the cooling source 55, and thereafter to cool the item 56 through the heat exchanger 60. The heat exchanger 62, which may be of tube-in-tube type, operates to minimize the unwanted heat load on the cooling source 55. If the source 55 should fail, closing the valve 63 effectively isolates it from the item 56; and opening of another valve, such as the valve 63′, enables cooling of the item 56 to be continued by an alternative cooling source, such as the source 55′, in one of the alternative circuits. Alternatively, in normal operation the item 56 may be cooled simultaneously by a plurality of cooling sources such as the source 55, with a plurality of the valves such as the valve 63 being normally open. In that case if one of the cooling sources fails it may be isolated from the item 56 by closing the corresponding valve, with the result that the failed cooling source imposes minimum heat loading on the item 56.

We claim:

1. A multi-stage cryogenic cooling apparatus comprising:

a closed-loop Joule-Thomson expansion stage and at least one pre-cooler stage linked with the Joule-Thomson stage through a first heat exchanger, the Joule-Thomson stage including:

a gas compressor, a Joule-Thomson expansion chamber constituting a second heat exchanger in heat-exchanging relationship with a thermal load that is to be cooled and having an inlet formed as a flow-restricting Joule-Thomson expansion valve and an outlet, a high-pressure gas line connected to supply high-pressure gas via said first heat exchanger to said inlet, a low-pressure gas return line connecting said outlet to the compressor, a Joule-Thomson stage heat exchanger in which the low-pressure return line adjacent said outlet is in heat exchanging relationship with the high-pressure line between the first heat exchanger and said inlet, and a third heat exchanger wherein the low-pressure return line adjacent the compressor is in heat-exchanging relationship with the high-pressure line between the compressor and the first heat exchanger, wherein the high-pressure line is provided, between the compressor and the third heat exchanger, with a branch leading through a bypass valve to a bypass line which passes through the first and third heat exchangers and opens into the expansion chamber through a second inlet and offers a less constricted gas route than the flow-restricting expansion valve, and wherein the bypass line being disposed so that the bypass line passes from the first heat exchanger to the second inlet without passing through said Joule-Thomson stage heat exchanger.

2. A cryogenic cooling apparatus as claimed in claim 1, wherein the pre-cooler stage comprises respective heat exchangers in which gas in the high-pressure supply line and in the bypass line is cooled.

3. A cryogenic cooling apparatus as claimed in claim 1, wherein two pre-cooler stages are provided, each of which comprises respective heat exchangers in which gas in the high-pressure supply line and in the bypass line is cooled.

4. A cryogenic cooling apparatus as claimed in claim 1, wherein the cooling at the precooler stage is effected by means of a Stirling-cycle refrigerator.

5. A cryogenic cooling apparatus as claimed in claim 1, wherein the closed-loop Joule-Thomson stage includes, in addition to said Joule-Thomson stage heat exchanger, a second Joule-Thomson stage heat exchanger in which the low-pressure return line is in heat-exchanging relationship with the high-pressure supply line and with the bypass line between the gas compressor and the precooling stage.

6. A cryogenic cooling apparatus as claimed in claim 3, wherein the closed-loop Joule-Thomson stage further includes a second Joule-Thomson stage heat exchanger in which the low-pressure return line is in heat exchanging relationship with the high-pressure supply line and with the bypass line between the two pre-cooler stages.

7. A cryogenic cooling apparatus as claimed in claim 5 or claim 6, wherein a Joule-Thomson stage heat exchanger in which the low-pressure return line is in heat exchanging relationship with both the high-pressure supply line and the bypass line comprises an outer tube and two inner tubes which extend beside one another through the outer tube, the outer tube being a portion of the low-pressure return line and the inner tubes being portions of, respectively, the high-pressure supply line and the bypass-line.

8. A cooling means comprising:

a source of flow of a fluid, a supply line for supplying fluid from said source to a first heat exchanger, where it is cooled by a source of cryogenic cooling, and thereafter to a second heat exchanger where it is in heat-exchanging relationship with an item to be cooled by the cryogenic cooling source, and a return line for return flow of the fluid from the second heat exchanger to the fluid flow source, the return line and the supply line between the fluid flow source and the first heat exchanger being in heat exchange relationship with one another in a third heat exchanger, and there being provided in the supply line between the fluid flow source and the third heat exchanger a control valve whereby the flow of fluid through the supply line and from the first to the second heat exchanger can be controlled, a second supply line is in parallel with said supply line through the third heat exchanger so as to be in heat exchanging relationship with the return line and through the first heat exchanger so as to be to be cooled by the cryogenic cooling source, said second supply line being connected to supply fluid from the fluid source to the second heat exchanger, the second heat exchanger being a Joule-Thomson expansion chamber and the second supply line opening thereinto through an inlet formed of a flow-restricting expansion valve therefor.

9. A cooling means as claimed in claim 8, wherein the return line is a fluid outlet from the Joule-Thomson expansion chamber and the fluid supply line having said control valve connected therein opens into the expansion chamber through a less restrictive inlet than that provided for said second supply line, whereby fluid flow into the expansion chamber is preferentially through one of the supply line having the control valve connected therein and through the second supply line, respectively, depending upon whether the control valve is open or closed.

10. A cooling means as claimed in claim 9, wherein a fourth heat exchanger in which the return line between the Joule-Thomson expansion chamber and the third heat exchanger is in heat exchanging relationship with said second supply line between the first heat exchanger and the Joule-Thomson expansion chamber.

11. A cooling means as claimed in claim 10, wherein the supply line in which the control valve is provided bypasses said fourth heat exchanger and is not, at that position, in heat exchanging relationship with the return line.

* * * * *